US012808272B1

(12) United States Patent
Alsaud et al.

(10) Patent No.: US 12,808,272 B1
(45) Date of Patent: Nov. 24, 2026

(54) INJECTING CHEMICALS INTO A WELLBORE WHILE DRILLING

(71) Applicant: Saudi Arabian Oil Company, Dhahran (SA)

(72) Inventors: Sara Abu Alsaud, Al Qatif (SA); Aaron Swanson, New Waverly, TX (US); Klemens Katterbauer, Dhahran (SA); Martin E. Poitzsch, Northumberland, NH (US); S. Sherry Zhu, Waban, MA (US); Hyung Tae Kwak, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/323,437

(22) Filed: Sep. 9, 2025

(51) Int. Cl.

| | |
|---|---|
| ***E21B 21/06*** | (2006.01) |
| ***E21B 21/10*** | (2006.01) |
| ***E21B 27/02*** | (2006.01) |
| ***E21B 34/02*** | (2006.01) |
| ***E21B 34/16*** | (2006.01) |
| ***E21B 47/04*** | (2012.01) |

(52) U.S. Cl.
CPC ..... *E21B 27/02* (2013.01); *E21B 34/02* (2013.01); *E21B 34/16* (2013.01); *E21B 47/04* (2013.01)

(58) Field of Classification Search
CPC ..... E21B 21/06; E21B 21/062; E21B 21/068; E21B 21/10; E21B 21/106; E21B 47/04
See application file for complete search history.

(56) References Cited

U.S. PATENT DOCUMENTS

| | | | | |
|---|---|---|---|---|
| 2,214,674 | A * | 9/1940 | Hayward | E21B 47/04 73/152.31 |
| 5,277,263 | A * | 1/1994 | Amen | E21B 49/005 175/42 |
| 6,324,904 | B1 * | 12/2001 | Ishikawa | E21B 47/138 257/E29.022 |
| 8,627,902 | B2 | 1/2014 | Hammer et al. | |
| 10,808,529 | B2 | 10/2020 | Ow et al. | |
| 11,512,576 | B2 | 11/2022 | Katterbauer et al. | |
| 11,719,092 | B2 | 8/2023 | Katterbauer et al. | |

(Continued)

OTHER PUBLICATIONS

Poitzsch et al., "Nanotags for Improved Cutting Depth Correlation," Presented at the SPWLA Annual Logging Symposium, held virtually, May 17-20, 2021, 2 pages (Abstract Only).

(Continued)

*Primary Examiner* — Kenneth L Thompson
(74) *Attorney, Agent, or Firm* — Fish & Richardson P.C.

(57) ABSTRACT

Systems and methods for injecting chemicals into a drilling fluid flow line include a tank configured to hold a chemical. A dosage cylinder is coupled to a bottom portion of the tank and configured to hold a specified amount of chemical. A first valve is coupled between the tank and the dosage cylinder. The first valve is configured to control a flow of the chemical from the tank into the dosage cylinder. A second valve is coupled between the dosage cylinder and a drilling fluid flowline. The second valve is configured to control a flow of the chemical from the dosage cylinder into the drilling fluid flowline. A control system is configured to open the first valve to fill the dosage cylinder with chemical and to open the second valve to inject the tagging material into the drilling fluid flowline.

20 Claims, 8 Drawing Sheets

(56) References Cited

U.S. PATENT DOCUMENTS

| | | | | |
|---|---|---|---|---|
| 11,860,137 | B2 | 1/2024 | Atwah | |
| 12,286,582 | B2 * | 4/2025 | Solovyeva | C09K 8/032 |
| 2010/0044034 | A1 * | 2/2010 | Bailey | E21B 47/138 175/42 |
| 2019/0368336 | A1 | 12/2019 | Hammond | |
| 2022/0251951 | A1 | 8/2022 | Ismailova et al. | |
| 2024/0167381 | A1 | 5/2024 | Katterbauer et al. | |

OTHER PUBLICATIONS

Thomas et al., "Automatic Injection of NanoTags for Improved Cutting Depth Correlation," Presented at the SPWLA 64th Annual Logging Symposium, Lake Conroe, Texas, Jun. 10-14, 2023, 6 pages (Abstract Only).

Zhu et al., "Encapsulated Fluorescent Tags to Label Drill Cuttings for Improved Depth Correlation: A Field Application," SPE Journal, Sep. 2024, 29(9)4804-4815, 6 pages (Abstract Only).

Zhu et al., "Evolution of the Chemistry of NanoTags for Improved Reservoir Characterization Accuracy," Presented at the International Petroleum Technology Conference, Dhahran, Saudi Arabian, Feb. 2024, 5 pages (Abstract Only).

* cited by examiner

INJECTING CHEMICALS INTO A WELLBORE WHILE DRILLING

TECHNICAL FIELD

The present disclosure relates to systems and methods for injecting chemicals (e.g., tagging materials) into drilling fluid while drilling a wellbore in a subsurface formation.

BACKGROUND

An oil well is a drillhole boring in Earth that is designed to bring petroleum oil hydrocarbons to the surface. Usually, some natural gas is released as associated petroleum gas along with the oil. A well that is designed to produce only gas may be termed a gas well. Wells are created by drilling down into an oil or gas reserve and if necessary equipped with extraction devices such as pumpjacks. Creating the wells can be an expensive process, costing at least hundreds of thousands of dollars, and costing much more when in difficult-to-access locations, e.g., offshore. The process of modern drilling for wells first started in the 19th century but was made more efficient with advances to oil drilling rigs and technology during the 20th century.

Drilling fluids are used in oil and gas drilling to assist with lubricating the drill bit, ensuring well safety, forming filter cakes to minimize fluid loss into drilling formations, and transporting drill cuttings (such as rock debris) to the surface of the well. As such, drilling fluids are integral to the drilling process. Drilling fluids can include a mixture of various chemicals in a water- or oil-based solution and can be expensive to make. For both environmental reasons and economic reasons, drilling fluid losses can be reduced by stripping drilling fluid away from drill cuttings, so that the drilling fluid can be recovered and reused in the drilling process. The drill cuttings separated from the drilling fluid can be analyzed to determine characteristics of the well.

SUMMARY

This disclosure describes an approach for injecting chemicals into a wellbore while drilling. For example, this approach can be used to inject tagging material into the drilling fluid to enable an assignment of depth in the wellbore to drill cuttings brought to the surface in the drilling fluid. This approach includes a tank or cylinder that can be filled with tagging material. A first valve can be controlled to allow a flow of dosing material from the tank into a dosage cylinder that can hold a measured amount of the tagging material. A second valve can be controlled to inject the tagging material into a flowline of the drilling slurry. The injection can be controlled by a control system to automatically inject tagging material according to a precise injection rate and injection schedule. The precision of injection of the tagging material improves the assignment of depth to the drill cuttings.

In an example implementation of this approach, a system for injecting tagging material into a drilling fluid includes a tank configured to hold tagging material, a dosage cylinder coupled to the bottom of the tank, a first valve coupled between the tank and the dosage cylinder, and a second valve coupled between the dosage cylinder and a drilling fluid flowline. The dosage cylinder is configured to hold a specified amount of tagging material. The first valve is configured to control flow of the tagging material from the tank into the dosage cylinder, and the second valve is configured to control a flow of the tagging material from the dosage cylinder into the drilling fluid flowline. A control system is communicatively coupled to the first valve and the second valve. The control system includes at least one processor, and a computer-readable medium is configured to operate the first valve to fill the dosage cylinder with tagging material and to operate the second valve to inject the tagging material into the drilling fluid.

Implementations of the systems and methods of this disclosure can provide various technical benefits. For example, the described systems and methods can inject both liquid tagging material and solid tagging material in a liquid suspension into the drilling fluid. The described systems and methods can use multiple different tagging materials to make unique combinations that improve the correlation of depth with the tagging material. The described systems and methods can be automated to inject the tagging material into the wellbore improves precision and accuracy of the depth correlation compared to manual injections. The improved precision arises because, when injected by the described systems and methods, the tagging material is injected at a precise location and not smeared over a large depth range as occurs when manually adding tagging material. The described systems and methods divert a small amount of drilling fluid from the drilling fluid pipe. The described systems and methods can be retrofitted onto currently used drilling equipment by tying the system into the drilling fluid pipe between the mud pit and circulation pump. The described systems and methods can be combined with a gas injection to determine volumetric changes to the borehole size (e.g., enlargement) that can indicate hole instability. Additionally, the estimated volume change can create a factor to adjust lag calculation. When combined with the tag injection the described systems and methods can provide assurance of lag and rock depth origin.

The details of one or more embodiments of these systems and methods are set forth in the accompanying drawings and the description below. Other features, objects, and advantages of these systems and methods will be apparent from the description and drawings, and from the claims.

BRIEF DESCRIPTION OF THE DRAWINGS

Like reference symbols in the various drawings indicate like elements.

DETAILED DESCRIPTION

This disclosure describes an approach for injecting chemicals into a wellbore while drilling. For example, this approach can be used to inject tagging material into the drilling fluid to enable an assignment of depth in the wellbore to drill cuttings brought to the surface in the drilling fluid. This approach includes a tank or cylinder that can be filled with tagging material. A first valve can be controlled to allow a flow of dosing material from the tank into a dosage cylinder that can hold a measured amount of the tagging material. A second valve can be controlled to inject the tagging material into a flowline of the drilling slurry. The injection can be controlled by a control system to automatically inject tagging material according to a precise injection rate and injection schedule. The precision of injection of the tagging material improves the assignment of depth to the drill cuttings.

Figure 1A:
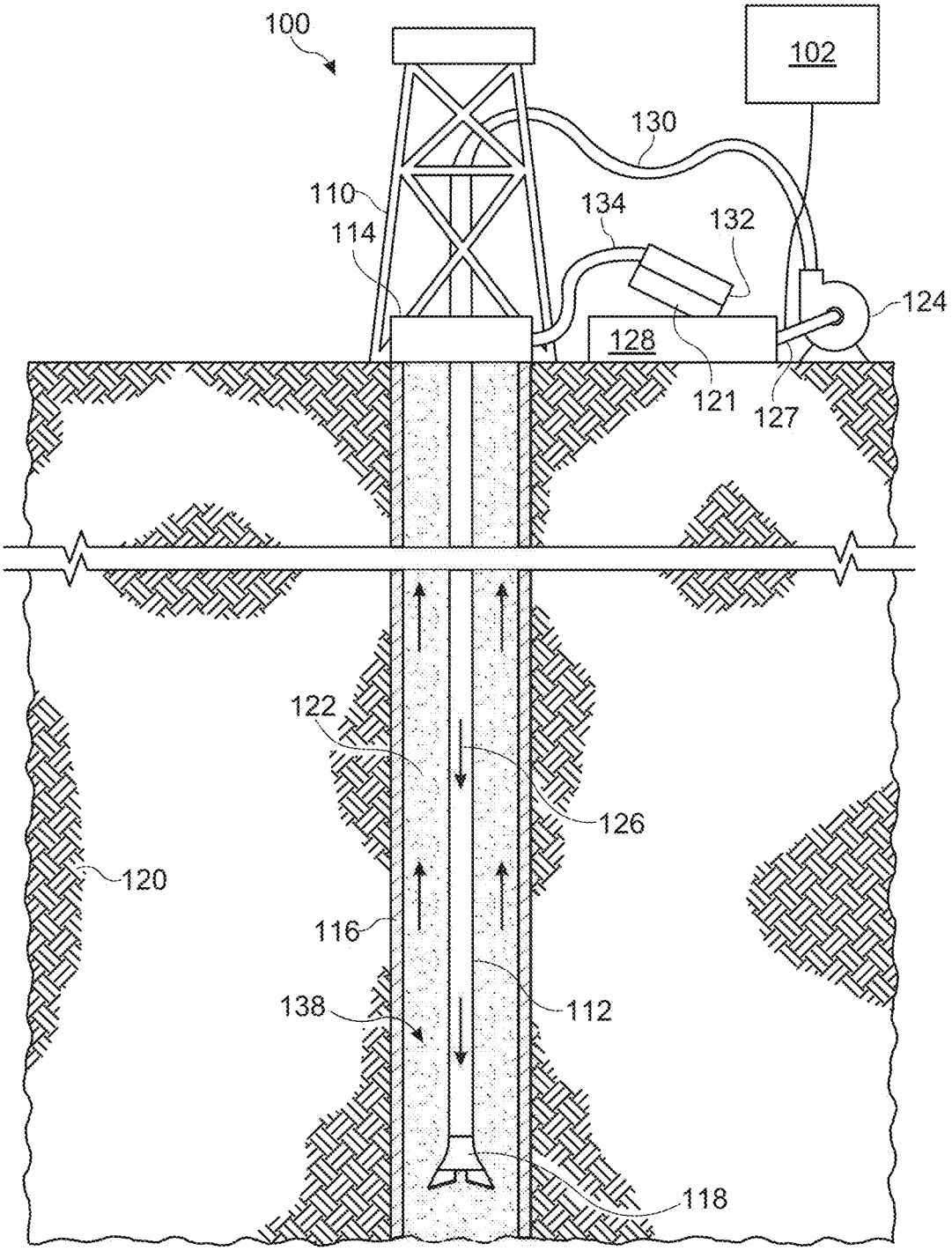
FIG. 1A is a schematic illustration of a drilling system.

FIG. 1A shows a schematic of an example drilling system 100 and an associated chemical injection system 102 for injecting tagging material into the drilling fluid. The drilling system 100 includes a derrick 110 that supports the weight of and permits selective positioning of a drill string 112 through a blowout preventer 114 at the wellhead of a wellbore 116. The drill string 112 has a downhole end coupled to a drill bit 118 operable to drill the wellbore 116 in a formation 120. To facilitate drilling and removal of drill cuttings 122, a circulation pump 124 circulates drilling fluid 126 though the wellbore 116. An inlet of a circulation pump 124 is coupled to a reservoir for the drilling fluid through a first pipe 127. In the illustrated system, the reservoir is a mud pit 128. In some systems, the reservoir can be, for example, one or more tanks. A pump discharge of the circulation pump 124 is coupled to a top end of the drill string 112 through a second pipe 130. The blowout preventer 114 is coupled to a shaker table 132 through a third pipe 134. The mud pit 128 is coupled to the shaker table 132 and receives the drilling fluid 126 from the shaker table 132.

During drilling, the drilling fluid 126 is pumped from the mud pit 128 and flows through the first pipe 127 into the pump suction of the circulation pump 124. The circulation pump 124 then pumps the drilling fluid 126 from the pump discharge to the top end of the drill string 112 through the second pipe 130. The tagging material 138 is introduced into the drilling fluid 126 between the mud pit 128 and the circulation pump 124. In some implementations, the tagging material 138 can be introduced into the drilling fluid 126 between the circulation pump 124 and the blowout preventer 114.

Depth can be assigned to cuttings brought to the surface by the drilling fluid during mud logging by using a lag-time method. For example, a volumetric calculations-based method can be used to estimate the arrival of drill cuttings liberated at the bit and carried to the surface by the drilling fluid. Volumetric calculations assume that the wellbore has an exact geometry based on the bit size and hole depth. Actual arrival time can vary significantly due to hole enlargement, fluid loss from or gain within the wellbore, or other factors related to the wellbore geometry or drilling operation which can result in, for example, a +/−20 ft (6.1 m) depth variation. Tagging of drill cuttings allows precise assignment of depth to produced cuttings using molecular taggants. Analysis of these cuttings are used to assign geological information to depths in the wellbore, which petrophysicists and geochemists can use to characterize a reservoir in the subsurface. More accurate assignment of depth to the drill cuttings results in more accurate reservoir and geological characterization.

Figure 1B:
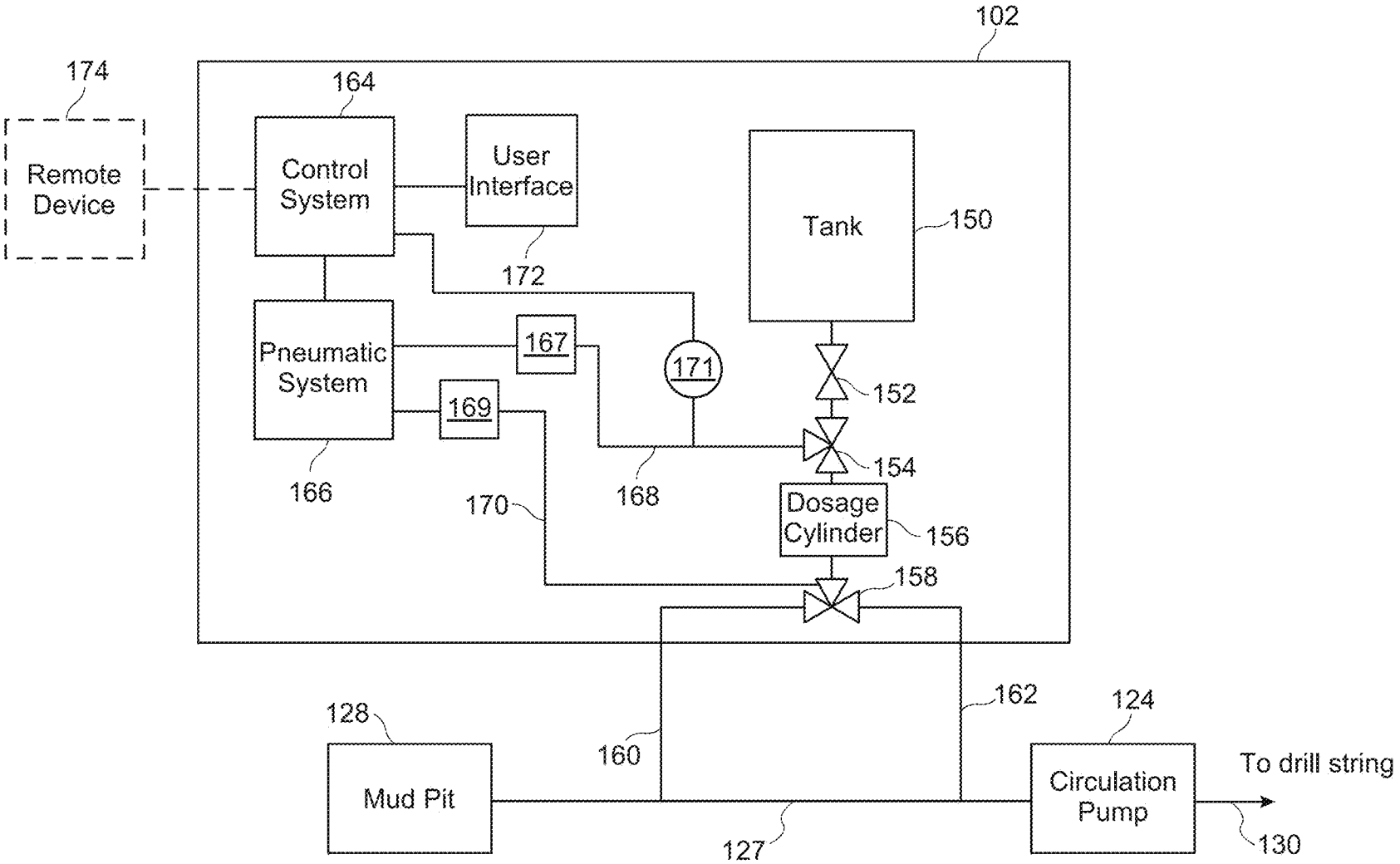
FIG. 1B is a block diagram for a system for injection tagging material into a drilling fluid flowline.

FIG. 1B is an example block diagram for the chemical injection system 102. The system 102 is coupled to the pipe 127 between the mud pit 128 and the circulation pump 124. Thus, chemical injected into the drilling fluid flows into the pipe 127, through the circulation pump 124, and through the second pipe 130 to the drill string. Connecting the chemical injection system 102 between the mud pit 128 and the circulation pump 124 eliminates the need for an additional pump by using the pressure of the circulation pump 124 to draw drilling fluid through the chemical injection system 102.

The system 102 includes a tank 150 that can hold a chemical such as a tagging material or other chemical in liquid form or a suspension of solid particles of a chemical suspended in a liquid. A series of valves 152, 154 controls flow of the chemical from the tank 150 into a dosage cylinder 156. A first valve 152, can be a valve to control a flow rate of the chemical from the tank 150. The first valve 152 can be adjusted to a partially open position to set a specified flow rate of the chemical through the valve 152. The valve 152 can be a manually operated valve or an actuated valve. Once the flow rate is set, the first valve 152 can remain in the partially open position. A second valve 154 is coupled between the first valve 152 and the dosage cylinder 156. The second valve 154 is a three-way valve with two inlets and an outlet. One inlet is configured to receive the chemical from the tank 150, the second inlet is configured to receive a flow of air from a pressurized source, and the outlet is configured to discharge the chemical or air into the dosage cylinder 156. The second valve 154 can be a pneumatically or electrically actuated valve. Using a pneumatic valve can be advantageous in an environment that may contain combustible gases or other energetic materials that could ignite from an electrical spark.

The dosage cylinder 156 is configured to hold a specified amount of chemical. The interior volume of the dosage cylinder 156 can be determined based on the chemical that is in the tank 150 and the desired amount of chemical to be injected into the drilling fluid during a single injection event. The dosage cylinder is capable of being pressurized above the pressure of the drilling fluid to enable injection of the chemical into the drilling fluid. In some implementations, the dosage cylinder 156 can be made from a clear material or include a see-through window to enable visual inspection of the chemical in the dosage cylinder 156. This enables visual verification of an injection and can aid troubleshooting in the event of a system malfunction. In some implementations, the dosage cylinder 156 is interchangeable such that the dosage cylinder 156 can be removed from the system 102 and replaced with a different dosage cylinder (e.g., a dosage cylinder configured to hold a different amount of chemical).

The third valve 158 is coupled to the dosage cylinder and the drilling fluid flow line 127. The third valve 158 is a three-way valve with a first inlet coupled to the dosage cylinder configured to receive chemical from the dosage cylinder, a second inlet coupled to the drilling fluid flow line 127 through inlet pipe 160 configured to receive drilling fluid, and an outlet coupled to the drilling fluid flow line 127 through outlet pipe 162 configured to discharge drilling fluid and injected chemical. The third valve 158 can be a pneumatically or electrically actuated valve. Using two sets of valves (e.g., valves 154 and 158) to inject chemicals is advantageous to provide isolation between the drilling fluid and the tank 150. Isolation reduces contamination of the chemicals in the tank 150 and enables more uniform flow control while injecting the chemical into the drilling fluid.

The system 102 includes a control system 164. The control system 164 includes one or more processors and a computer readable medium storing instructions to perform operations of the system 102. The control system is communicatively coupled to a pneumatic system 166. The control system 164 is operable to send commands to the pneumatic system 166 to operate one or more of the valves 154 and 158. The pneumatic system 166 can include a directional control valve that can receive commands generated by the control system 164 and cause pressurized air to flow through one or more pneumatic lines to operate the valves 154 and 158. The valves 154 and 158 are coupled to the pneumatic system through pneumatic lines 168 and 170. Each pneumatic line 168, 170 has a pressure regulator 167, 169 to ensure that the pressure received by the valves 154 and 158 is within a specified pressure value for operating the valves 154 and 158. The pressure regulators 167 and 169 enable the air pressure for each of the valves 154 and 158 to be controlled independently. Additionally, a pressure sensor 171 can be coupled to the pneumatic lines (e.g., 168). The pressure sensor 171 is communicatively coupled to the control system 164 and can provide feedback to the control system 164 on the operational status and/or status changes of the system 102. For example, in response to commanding an injection event, the control system 164 can receive a signal from the pressure sensor 171. Based on the received signal, the control system 164 can determine that the injection event occurred. If the injection event did not occur, the control system 164 can generate an alarm or error signal to notify a user that the injection event did not occur. The alarm signal can be, for example, an audio and/or visual alert such as a sound, a flashing light, a pop-up message on a display device, a text message, etc. The control system 164 can determine an amount of chemical remaining in the tank 150.

The control system 164 is communicatively coupled to a user interface 172. The user interface 172 can be, for example, a touch screen, a tablet computer, a keyboard, etc. A user can input system parameters and adjust the settings of an injection event through the user interface 172. Additionally, the user can operate individual system components and/or injection events through the user interface 172.

The control system 164 can be communicatively coupled to a remote device 174. The remote device 174 can be, for example, a server, a computer system, a smartphone, a tablet, a laptop, etc. The control system 164 can send data to and receive data from the remote device 174. For example, the control system 164 can send system status, logs of injection events, and/or error messages to the remote device 174. The remote device 174 can send, for example, configuration files, system settings, parameters of injection events, etc. In some implementations, the system 102 can be operated by the remote device 174.

Although only one tank 150 is shown in system 102, The system 102 is expandable and can include more than one tank with the associated valves and dosage cylinder can be incorporated into the system 102 and connected in series between the inlet 160 and the outlet 162. For example, the system 102 can include 2 tanks, 3 tanks, 4 tanks, or 5 or more tanks. Using multiple tanks enables more than one chemical or tagging material to be injected into the drilling fluid. In implementations with multiple tanks, the system 102 can inject multiple chemicals simultaneously and/or in a specified sequence to create uniquely identifiable patterns to better correlate the drill cuttings with the relevant injection event.

Figure 2A:
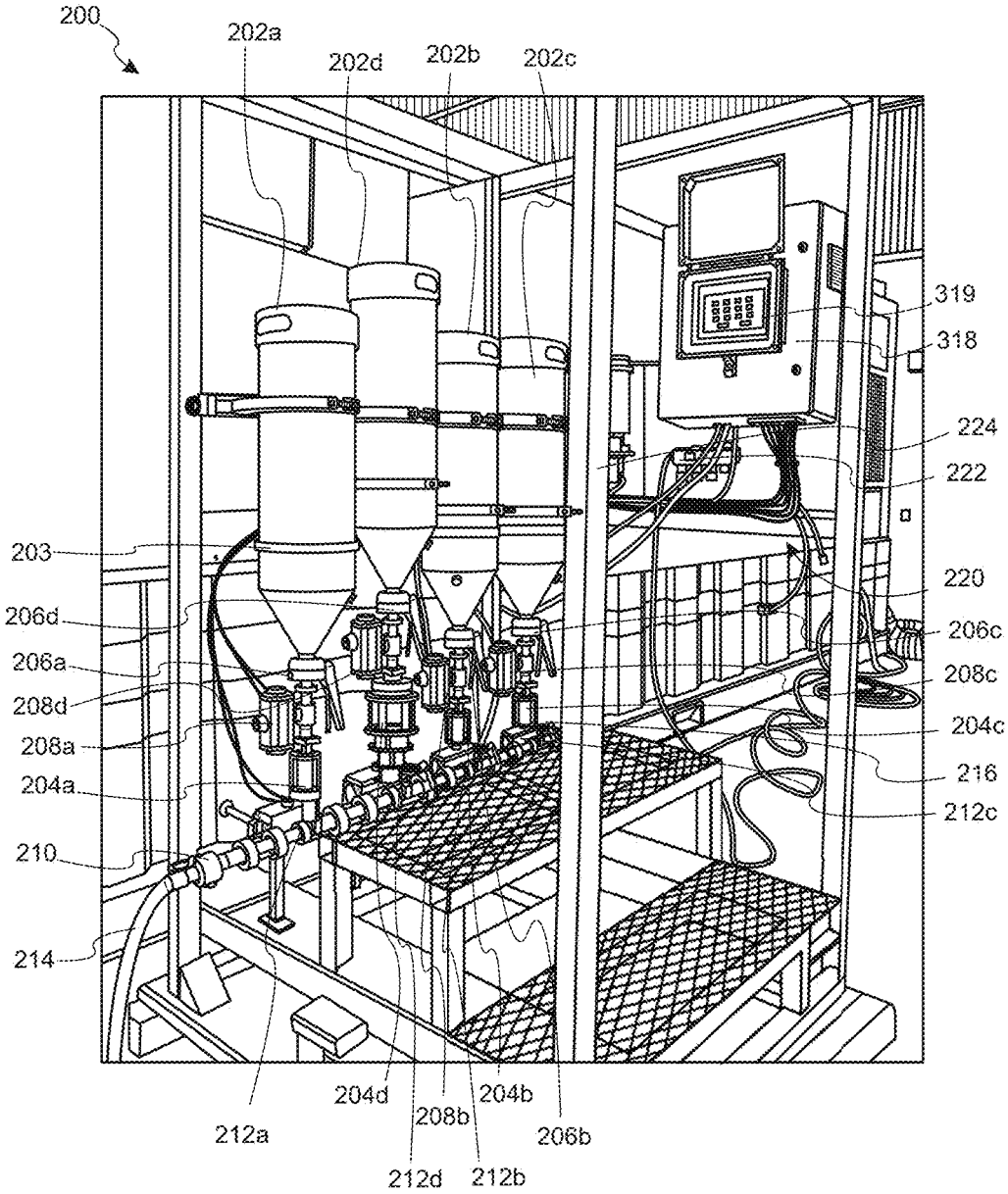
FIG. 2A is an angled view of a chemical injection system.

FIG. 2A is an angled view of an example chemical injection system 200 for injecting chemicals such as tagging material into drilling fluids while drilling a wellbore. The system 200 is similar to the system 102 and includes similar components. The system 200 includes four tanks 202*a-d* (collectively referred to as tanks 202) to hold chemical or tagging material. Including multiple tanks in a chemical injection system can enable various combinations or sequences of chemicals to be injected to form unique patterns that can be used to more precisely associate drill cuttings with specific injection events. Each tank 202*a-d* is configured such that chemical will flow out of the tanks 202*a-d* under the force of gravity. The tanks 202-*a-d* each include a pop-off or vent valve to relieve pressure inside the tanks 202*a-d* (e.g., pressure generated by evaporating chemical). The pop-off valve can be left open while operating the system 200. The volume of each the tanks 202*a-d* can be independently expanded by coupling an additional tank section to the respective tank 202*a-d*. For example, the tank 202*a* can be inserting an additional tank segment at the seam 203.

Each of the tanks 202 are coupled to a dosage cylinder. System 200 includes two sizes of dosage cylinders. Dosage cylinders 204*a-c* are one size, and dosage cylinder 204*d* is a larger size configured to hold more tagging material. The dosage cylinders 204*a-d* can be interchanged with other dosage cylinders to, for example, introduce a dosage cylinder with a different volume or to replace a faulty dosage cylinder. Between the tanks 202*a-d* and the dosage cylinders 204*a-d* are two valves 206*a-d* and 208*a-d*. The valves 206*a-d* are manual valves that are configured to control a flow rate of the chemical from the tanks 202*a-d* to the dosage cylinders 204*a-d*. The valves 208*a-d* are pneumatically actuated three-way valves with one inlet configured to receive chemical from the tanks 202*a-d*, one inlet configured to receive pressurized air to pressurize the dosage cylinder, and an outlet configured to discharge chemical or air into the dosage cylinders 204*a-d*. The dosage cylinders 204*a-d* can be partially or fully filled with chemical from the tanks 202*a-d* depending on a desired or specified amount of chemical to inject into the drilling fluid.

The dosage cylinders 204*a-d* are coupled to a drilling fluid flowline 210 through valves 212*a-d*. Drilling fluid can flow from an inlet 214 through the drilling fluid flowline 210 to an outlet. When installed at a drilling rig, the inlet 214 and outlet 216 can be connected to drilling fluid pipes between the mud pit and the circulation pump. The valves 212*a-d* are three-way valves with one inlet configured to receive drilling fluid, one inlet configured to receive chemical from the dosage cylinders 204*a-d*, and an outlet configured to discharge drilling fluid or chemical into the drilling fluid flowline 210.

The system 200 also includes a control box 218 housing a control system. For example, a programmable logic controller (PLC) can be housed in the control box 218 and be configured to operate the system 200. An example PLC that can be used in the system 200 is a PM 5052-T-ETH from ABB Inc., whose corporate headquarters are located at 305 Gregson Drive, Cary, North Carolina, 27511. A user interface 219 is mounted to the control box 218. Through the user interface 219, a user can adjust system parameters and send commands to operate the system 200.

The PLC can be configured to execute operations for injecting the chemicals. An example process for injecting chemical into a drilling fluid using the system 200 includes reading an address for a selected tank (e.g., 202*a*) and reading a timer duration for the selected tank. The PLC sends a command to open the valve (e.g., valve 208*a*) to allow the chemical to transfer from the tank to the dosage cylinder. The valve remains open for the timer duration. The timer duration can be adjusted based on time needed fill the cylinder (e.g., a more viscous chemical can take a longer time to fill than a less viscous chemical). The dosage cylinder can fill using the force of gravity (e.g., without air injection). At the end of the timer duration, the PLC sends a command to close the valve. The PLC reads the injection register and injection duration and checks to see if air injection is enabled. If enabled, the air injection valve is opened. The air injection valve (e.g., one of the inlets of valve 208*a*) allows pressurized air to flow into the dosage cylinder to pressurize the dosage cylinder. The dosage cylinder can be pressurized to a higher pressure than a pressure in the drilling fluid flow line, which advantageously allows the chemical to be injected in a quick, tight pulse rather than spread out over a longer time interval. The air pressure can be manually set on a pressure regulator. The PLC sends a signal to the flow valve (e.g., one of the inlets of the valve 212*a*) to close causing the flow of drilling fluid to stop. The PLC sends a signal to the injection valve (e.g., the other inlet of valve 212*a*) to open, and the flow valve remains open for the injection duration. Once the injection duration elapses, the PLC sends a signal to the injection valve to close and to the flow valve to open. The PLC can record the injection event in an injection log. The injected chemical can be tracked using a lag calculation to track "events" like pills or sweeps to determine when the injected chemical will return back to surface.

The control box 218 can also include fans to maintain operating environment temperatures for electronics in the control box. The fans can draw air through filters to reduce introduction of particulate that could damage the electronics. The control box 218 can house a transformer that steps voltage down from provided voltage (e.g., 120 V or 240 V) to 24 V to operate a 24 V system. Fuses can be included to protect the electronics from power surges. The control box can also house one or more directional control valves to direct pressurize air within a pneumatic system to operate pneumatically actuated valves. The control box 218 can also house sensors such as pressure transducers that are operable to measure a pressure in one or more pneumatic lines to verify operation of the pneumatic system and injection of chemical.

The system 200 includes a pneumatic system 220 that operates based on the flow of pressurized air. The pneumatic system 220 includes pressure regulators 222, 224 to control and maintain a stable pressure in the pneumatic system 220 to ensure the system is working safely and efficiently. Air pressure regulator 222 is operable to regulate air pressure coming from a pressurized air source (e.g., from a drilling rig), and to regulate the air pressure for opening and closing the valves 208*a-d* that sit directly below the tanks 202. Air pressure regulator 224 is operable to regulate the air pressure to operate the valves 212*a-d* to inject the tag material/chemicals into the flowline 210. The pneumatic system 220 can operate on air pressurized to 100 pounds per square inch (psi) (689.5 kilo-Pascals (kPa)). Components of the pneumatic system (e.g., directional control valves) can be housed in the control box 218.

Figure 2B:
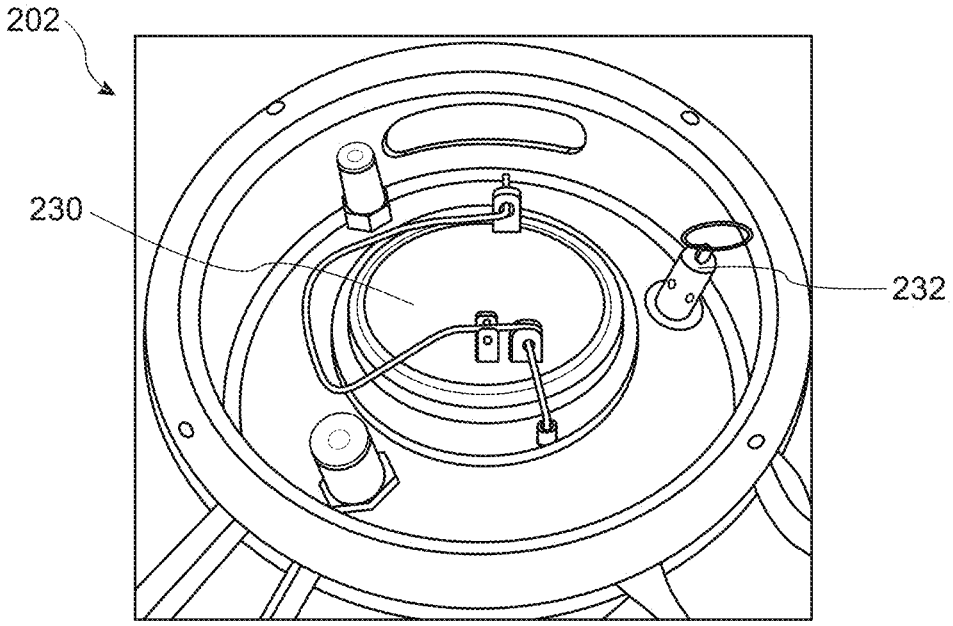
FIG. 2B is a top view of a tank for a chemical injection system.

FIG. 2B is a top view of one of the tanks 202. The top of the tank 202 includes an access door 230 that can be opened to fill the tank 202 with chemical. The access door 230 can be closed during operation, to prevent discharge of the chemical within the tank 202 through the access door 230 during operation of the system 200. The top of the tank 202 also includes a pop-off valve 232 to release pressure from inside the tank 202. The tank 202 is not intended to be a pressure containing vessel and would only be under pressure caused by evaporation of chemical. The pop-off valve 232 can remain open during system operation. This enables the continuous release of gases that would otherwise pressurize the tank 202. In addition, the pop-off valve enables air to enter the tank 202 when chemical is flowing into the dosage cylinder to avoid creating a vacuum.

Figure 2C:
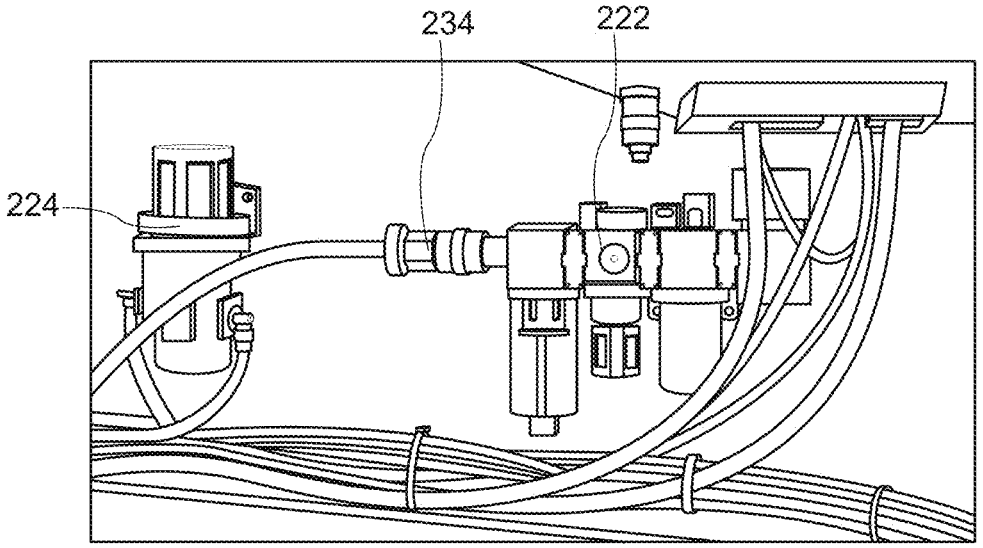
FIG. 2C is a detailed view of pressure regulators in a pneumatic system.

FIG. 2C is a close-up view of the air pressure regulators 222 and 224. Air pressure regulator 222 receives air pressure from a pressurized source through line 234. Air pressure regulator 222 also regulates the air pressure for the valves 208*a-d*. Air pressure regulator 224 regulates air pressure for operation of the valves 212*a-d*.

Figure 3A:
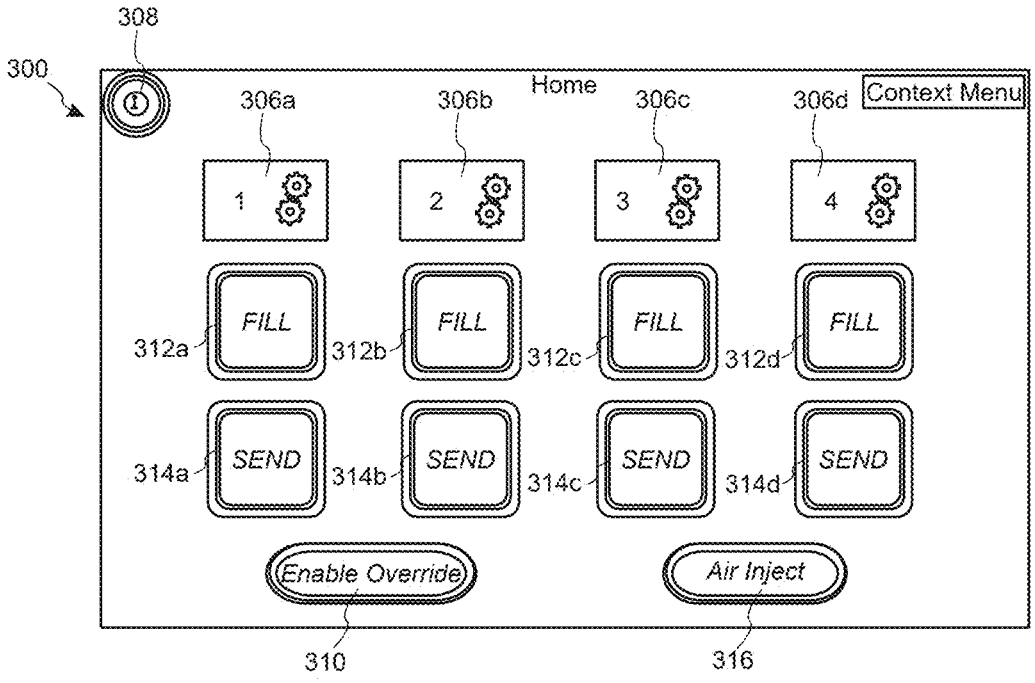
FIG. 3A-3C are example graphical user interfaces for a control system to control a chemical injection system.
Figure 3B:
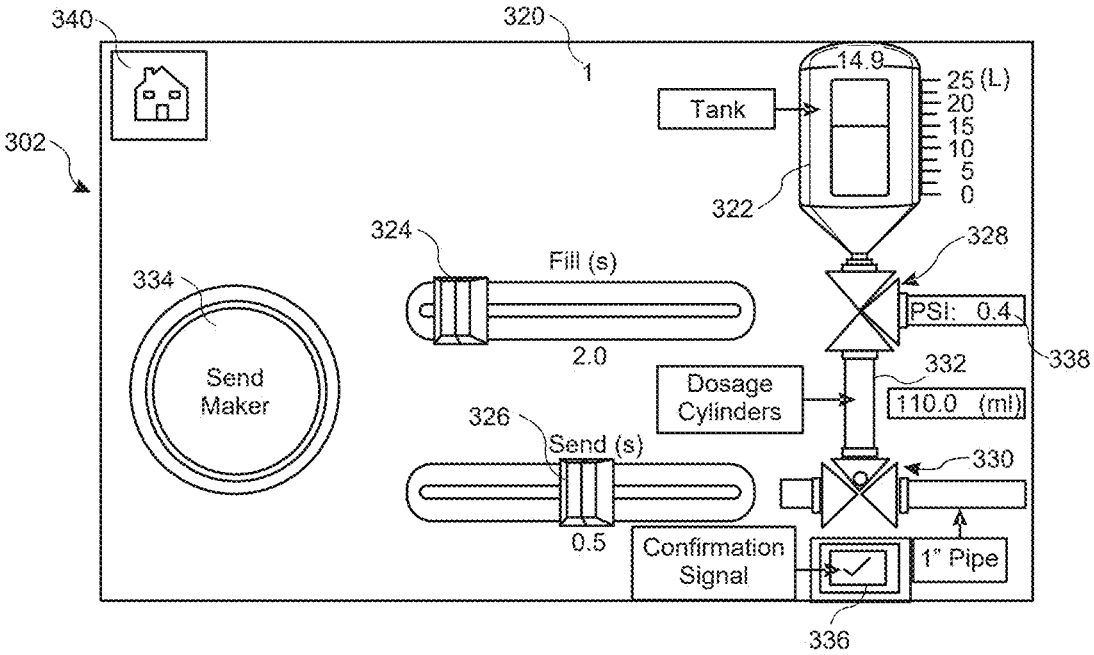
Figure 3C:
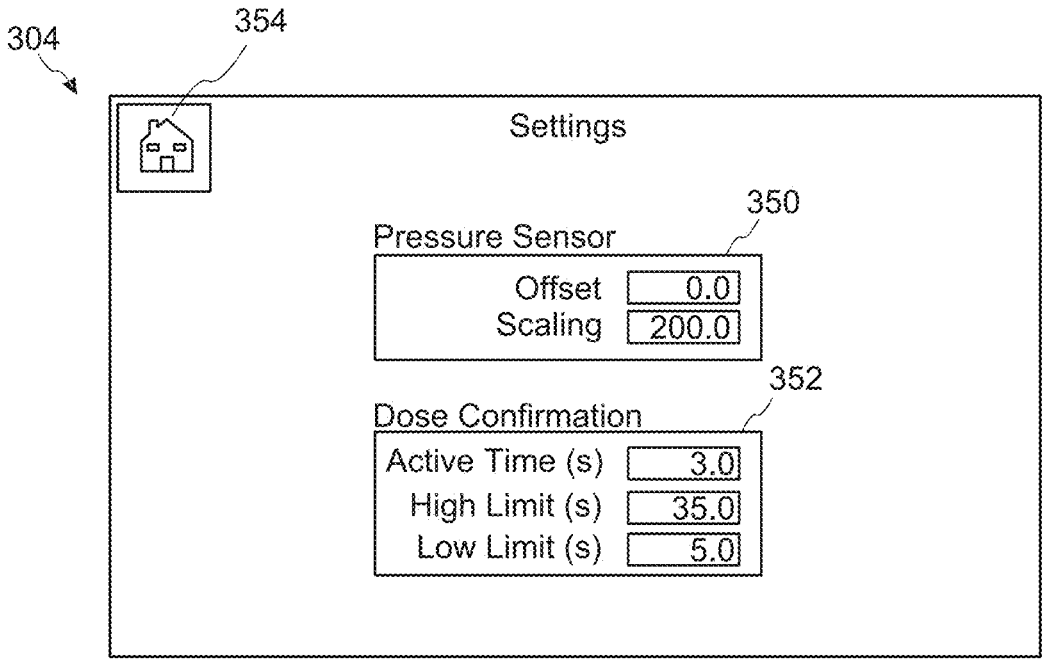

FIGS. 3A-3C show example graphical user interfaces 300-304 that can be displayed to a user to interact with and control a chemical dispensing system. For example, the graphical user interfaces 300-304 can be displayed on user interface 172 or 219. The functionality of the graphical user interfaces 300-304 is described below in terms of interacting with the interface using a touchscreen. Where buttons are described as being pressed, the button could also be clicked on or otherwise selected using a different user interface device (e.g., a keyboard or a mouse).

FIG. 3A shows graphical user interface 300 representing a home screen. Pressing on one of the numbered gear buttons 306*a-d* will cause graphical user interface 302 to display (FIG. 3B). Pressing on the "i" icon 308 displayed in the left corner, will cause graphical user interface 304 to display (FIG. 3C). Pressing on the "Enable Override" button 310 enables a manual operation mode where a user can manually perform operations with the connected system. For example, pressing one of the "Fill" buttons 312*a-d* will cause the valve to open to fill the dosage cylinder with chemical for the duration that the button 312*a-d* is pressed. Pressing one of the "Send" buttons 314*a-d* will cause the injection valve to open to allow the chemical from the dosage cylinder to flow into the drilling fluid flow line. The injection valve remains open as long as button 314*a-d* is pressed. Pressing on the "Air Inject" button 316 enables automatic injection based on settings input into the system.

FIG. 3B shows graphical user interface 302 that shows information related to one of the tanks of the system. The timer durations for filling and injecting chemical can be adjusted from this screen. The tank is identified by the number 320 in the upper middle of the screen. Tank graphic 322 shows the remaining chemical volume in the tank. The volume of chemical that is ultimately injected into the drilling fluid is controlled based on the filling and sending times. Slider 324 adjusts the fill time. Slider 326 adjusts the send time. Alternatively, the filling and sending times can be entered with an onscreen keypad (not shown) or other input device. The state of the three-way automatic valves are shown by graphics. The fill valve graphic 328 shows that the valve between the tank and dosage cylinder is closed. The injection valve graphic 330 shows that the valve is open to allow drilling fluid to flow through the valve but is closed to the dosage cylinder 332. Pressing on the "Send Marker" button 334 will cause an injection event to occur according to the selected fill and send times. Confirmation signal 336 indicates if the injection occurred successfully. A pressure reading 338 is also displayed showing the pressure in the dosage cylinder 332. Pressing on the home button 340 causes graphical user interface 300 to display.

FIG. 3C shows graphical user interface 304 that shows the pressure sensor parameters 350 and dose confirmation limit parameters 352. The pressure sensor parameters 350 include a pressure offset and a scaling value that can be adjusted to ensure that the correct pressure is displayed (e.g., in pressure reading 338) and used for dose confirmation. The dose confirmation parameters 352 include the duration of time the confirmation signal 336 is active after dose confirmation, and high and low pressure limits that indicate that the injection occurred. Each of these values can be adjusted by pressing on the relevant text box. Pressing on the home button 354 will cause graphical user interface 300 to be displayed.

Figure 4:
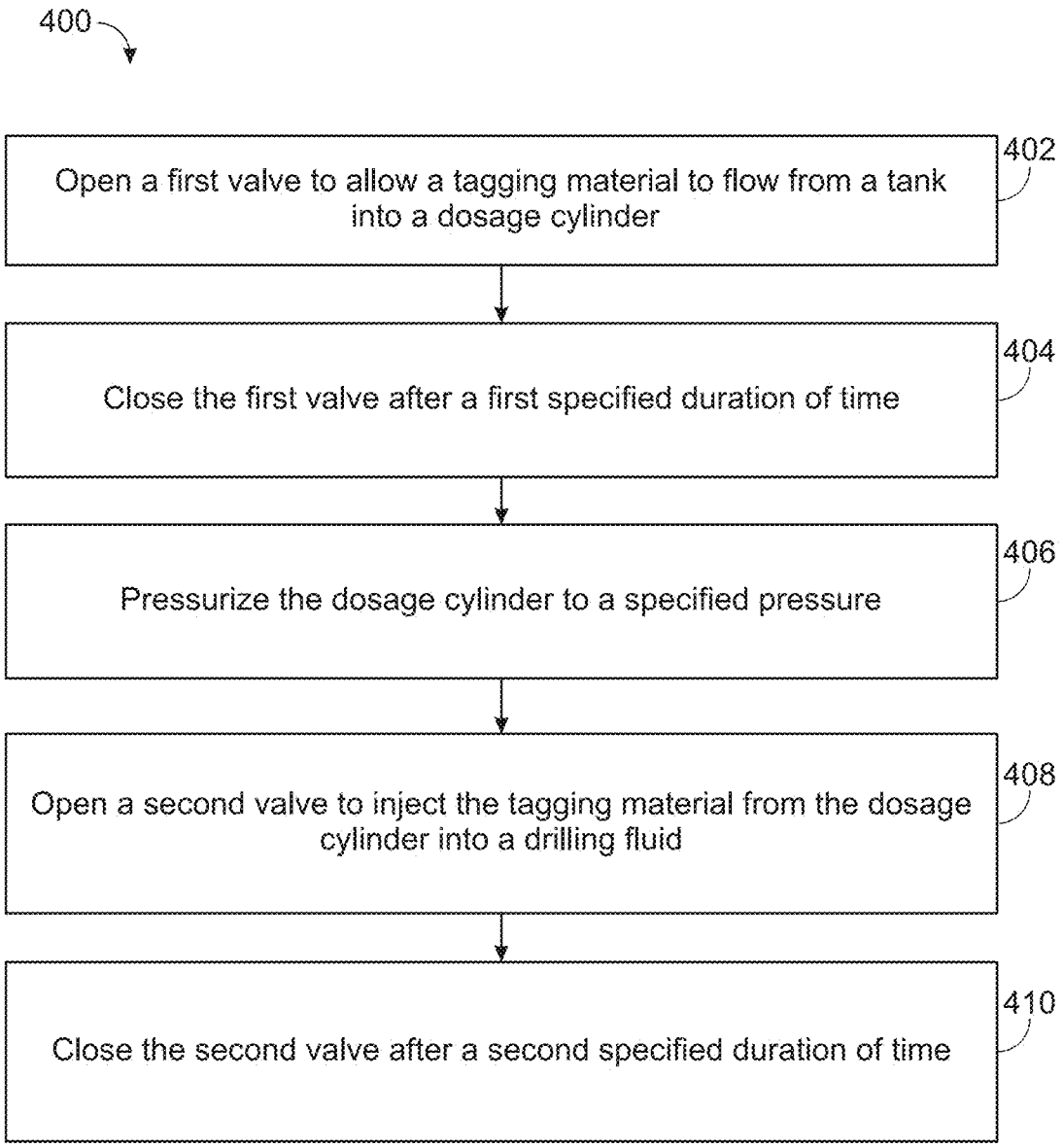
FIG. 4 is a flowchart for a method of injecting tagging materials into a drilling fluid.

FIG. 4 is a flowchart for a method 400 for injecting a tagging material into a drilling fluid. The method 400 can be implemented on a computer or control system such as control system 164, the control system in control box 318, or the computer system of FIG. 5.

The control system opens 402 a first valve to allow a first tagging material to flow from a tank into a dosage cylinder closing, by the control system. The control system closes 404 the first valve after a first specified duration of time. The first specified duration of time is a length of time for a specified volume of the tagging material to flow into the dosage cylinder. The control system pressurizes 406 the dosage cylinder to a specified pressure by enabling a pressurized gas to flow into the dosage cylinder. For example, the control system opens a pressurization valve to allow the pressurized gas to flow into the dosage cylinder. The dosage cylinder can be pressurized above the pressure of the drilling fluid to enable injection of the chemical into the drilling fluid. The control system opens 408 a second valve to inject the tagging material from the dosage cylinder into a drilling fluid flowline. The control system closes 410 the second valve after a second specified duration of time. The second specified duration of time is a length of time for the specified volume of the tagging material in the first dosage cylinder to be injected into the drilling fluid flowline.

In some implementations, the control system measures the pressure in a pneumatic system using a pressure transducer to confirm that the tagging material was injected into the drilling fluid flowline. In some implementations, the control system receives the first and second specified durations of time through a user interface such as graphical user interfaces 300-304. In some implementations, the control system injects tagging material into the drilling fluid flowline according to a specified schedule. For example, the control system can cause tagging material to be injected at a fixed interval (e.g., one injection every 10 minutes, 20 minutes, 30 minutes, 60 minutes, or 120 minutes or more). The set or specified schedule can be based on, for example, drilling parameters associated with drilling a wellbore in a subsurface formation. The volume of chemical injected during an injection event can also be adjusted based on drilling parameters. Such as drilling rate.

In some implementations the control system injects a second tagging material from a second tank into the drilling flowline. For example, the control system can open a third valve to allow the second tagging material to flow from the second tank into a second dosage cylinder. The control system can close the third valve after a third specified duration of time. The control system can open a fourth valve to inject the second tagging material from the second dosage cylinder into the drilling fluid flowline. The control system can close the fourth valve after a fourth specified duration of time.

In some implementations, the first tagging material and the second tagging material are injected in the drilling fluid flowline to form an identifiable combination of tagging materials. Forming combinations of tagging materials can be advantageous to uniquely correlate drilling cuttings that arrive at the surface with a particular injection of tagging material. In some implementations, the control system injects the first tagging material and the second tagging material into the drilling fluid flowline concurrently. In some implementations, the first tagging material and the second tagging material are injected sequentially.

Figure 5:
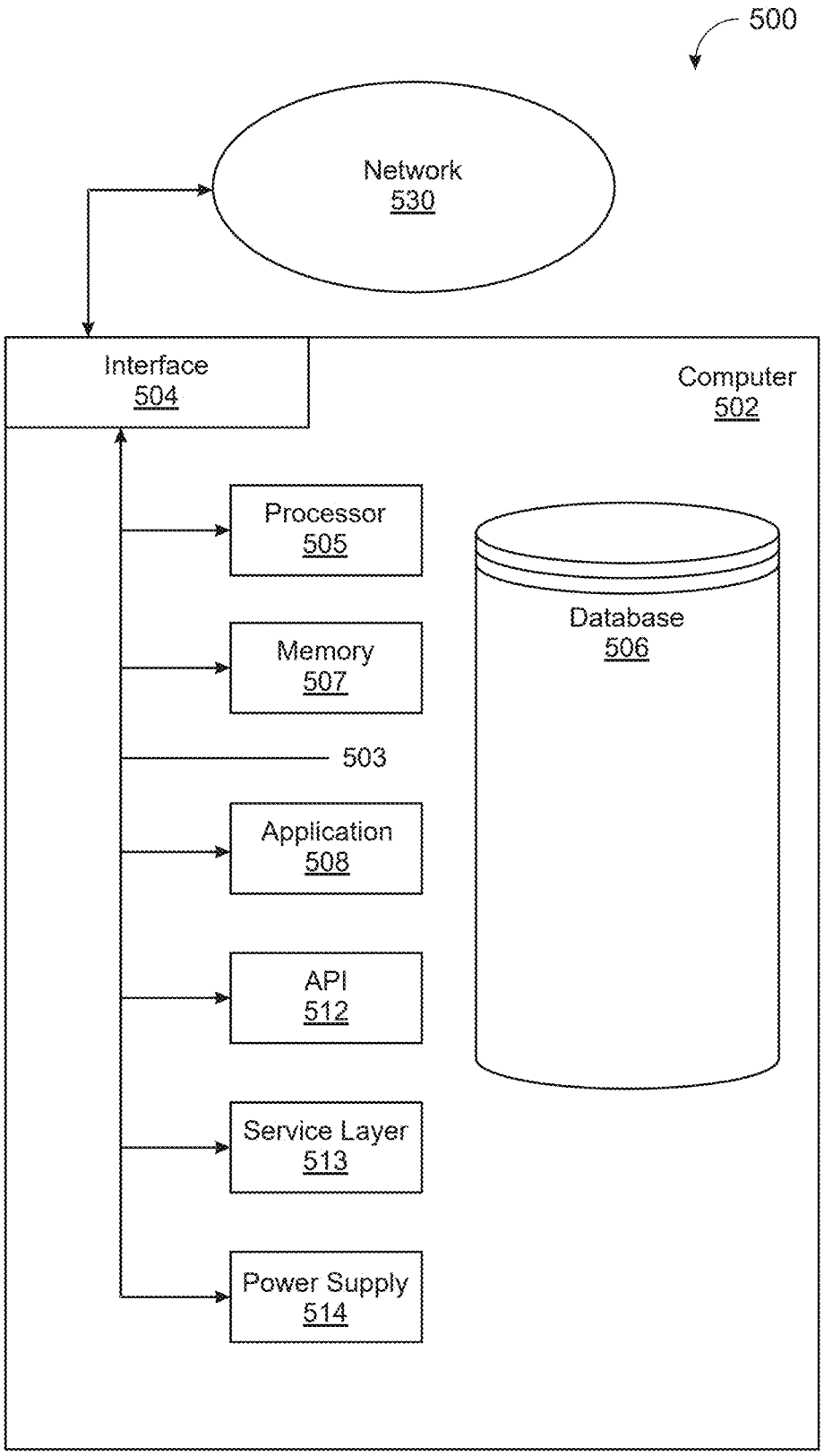
FIG. 5 is a block diagram illustrating an example computer system used to provide computational functionalities associated with described algorithms, methods, functions, processes, flows, and procedures according to some implementations of the present disclosure.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a high level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 503. In some implementations, any or all of the components of the computer 502, including hardware or software components, can interface with each other or the interface 504 (or a combination of both), over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 508 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

Examples

In an example implementation, a system for injecting tagging material into a drilling fluid flow line includes a tank configured to hold tagging material, and a dosage cylinder coupled to a bottom portion of the tank. The dosage cylinder is configured to hold a specified amount of tagging material to inject into drilling fluid. A first valve is coupled between the tank and the dosage cylinder. The first valve is configured to control a flow of the tagging material from the tank into the dosage cylinder. A second valve is coupled between the dosage cylinder and a drilling fluid flowline. The second valve is configured to control a flow of the tagging material from the dosage cylinder into the drilling fluid flowline. A control system includes at least one processor and a computer-readable medium storing instructions executable by the at least one processor. The control system is configured to open the first valve to fill the dosage cylinder with tagging material and to open the second valve to inject the tagging material into the drilling fluid flowline.

In an aspect combinable with the example implementation, the tank is oriented such that the tagging material is configured to flow to the dosage cylinder under a force of gravity.

Another aspect combinable with one, some, or all of the previous aspects includes a pneumatic system coupled to the control system, the control system configured to control the pneumatic system to open and close the first valve and the second valve.

In another aspect combinable with one, some, or all of the previous aspects, the pneumatic system includes pneumatic lines connected to the first valve and the second valve, and one or more pressure regulators configured to regulate a pressure in the pneumatic system.

In another aspect combinable with one, some, or all of the previous aspects, the pneumatic system includes one or more directional control valves configured to direct air flow within the pneumatic system to cause the first valve or the second valve to open or close.

In another aspect combinable with one, some, or all of the previous aspects, the control system is further configured to control two or more second valves to inject a desired combination of tagging material into the drilling fluid.

In another aspect combinable with one, some, or all of the previous aspects, for each tank a manual valve is coupled between the first valve and the tank, the manual valve configured to meter a flow of the tagging material through the first valve.

In another aspect combinable with one, some, or all of the previous aspects, each tank includes a pop-off valve operable to release pressure from inside the tank.

In another aspect combinable with one, some, or all of the previous aspects, the control system includes a user interface configured to display system information and receive input from a user.

In another aspect combinable with one, some, or all of the previous aspects, the input from the user includes one or more commands to actuate one or more of the first valves or second valves.

In another aspect combinable with one, some, or all of the previous aspects, the user interface includes a touchscreen mounted to a housing for the control system.

In another aspect combinable with one, some, or all of the previous aspects, the system includes at least two tanks, and a first dosage cylinder coupled to a first tank has a first volume, and a second dosage cylinder coupled to a second tank has a second volume, wherein the first and second volumes are different.

In another aspect combinable with one, some, or all of the previous aspects, the control system is configured to transmit data to and receive data from a remote computing system.

In another example implementation, a method for injecting tagging material into a drilling fluid includes opening, by a control system, a first valve to allow a first tagging material to flow from a first tank into a first dosage cylinder; closing, by the control system, the first valve after a first specified duration of time, the first specified duration of time being a length of time for a specified volume of the tagging material to flow into the first dosage cylinder; pressurizing, by the control system, the first dosage cylinder to a specified pressure by enabling a pressurized gas to flow into the dosage cylinder; opening, by the control system, a second valve to inject the first tagging material from the first dosage cylinder into a drilling fluid flowline; and closing, by the control system, the second valve after a second specified duration of time, the second specified duration of time being a length of time for the specified volume of the tagging material in the first dosage cylinder to be injected into the drilling fluid flowline.

An aspect combinable with the example implementation includes measuring, by the control system using a pressure transducer, a pressure in a pneumatic system to confirm that the first tagging material was injected into the drilling fluid flowline.

Another aspect combinable with one, some, or all of the previous aspects includes receiving, by the control system through a user interface, the first and second specified durations of time.

Another aspect combinable with one, some, or all of the previous aspects includes injecting, by the control system, a second tagging material from a second tank into the drilling flowline by opening, by the control system, a third valve to allow the second tagging material to flow from the second tank into a second dosage cylinder; closing, by the control system, the third valve after a third specified duration of time; opening, by the control system, a fourth valve to inject the second tagging material from the second dosage cylinder into the drilling fluid flowline; and closing, by the control system, the fourth valve after a fourth specified duration of time.

In another aspect combinable with one, some, or all of the previous aspects, the first tagging material and the second tagging material are injected in the drilling fluid flowline to form an identifiable combination of tagging materials.

In another aspect combinable with one, some, or all of the previous aspects, the first tagging material and the second tagging material are injected into the drilling fluid flowline concurrently.

Another aspect combinable with one, some, or all of the previous aspects includes automatically injecting, by the control system, tagging material into the drilling flowline according to a set schedule based on drilling parameters associated with drilling a wellbore in a subsurface formation.

What is claimed is:

1. A system for injecting tagging material into a drilling fluid flow line, the system comprising:

a tank configured to hold tagging material;

a dosage cylinder coupled to a bottom portion of the tank, the dosage cylinder configured to hold a specified amount of tagging material to inject into drilling fluid;

a first valve coupled between the tank and the dosage cylinder, the first valve configured to control a flow of the tagging material from the tank into the dosage cylinder; and a second valve coupled between the dosage cylinder and a drilling fluid flowline, the second valve configured to control a flow of the tagging material from the dosage cylinder into the drilling fluid flowline; and a control system comprising at least one processor and a computer-readable medium storing instructions executable by the at least one processor, the control system configured to open the first valve to fill the dosage cylinder with tagging material and to open the second valve to inject the tagging material into the drilling fluid flowline.

2. The system of claim 1, wherein the tank is oriented such that the tagging material is configured to flow to the dosage cylinder under a force of gravity.

3. The system of claim 1, further comprising a pneumatic system coupled to the control system, the control system configured to control the pneumatic system to open and close the first valve and the second valve.

4. The system of claim 3, wherein the pneumatic system comprises pneumatic lines connected to the first valve and the second valve, and one or more pressure regulators configured to regulate a pressure in the pneumatic system.

5. The system of claim 3, wherein the pneumatic system comprises one or more directional control valves configured to direct air flow within the pneumatic system to cause the first valve or the second valve to open or close.

6. The system of claim 1, wherein the control system is further configured to control two or more second valves to inject a desired combination of tagging material into the drilling fluid.

7. The system of claim 1, wherein for each tank a manual valve is coupled between the first valve and the tank, the manual valve configured to meter a flow of the tagging material through the first valve.

8. The system of claim 1, wherein each tank comprises a pop-off valve operable to release pressure from inside the tank.

9. The system of claim 1, wherein the control system comprises a user interface configured to display system information and receive input from a user.

10. The system of claim 9, wherein the input from the user comprises one or more commands to actuate one or more of the first valves or second valves.

11. The system of claim 9, wherein the user interface comprises a touchscreen mounted to a housing for the control system.

12. The system of claim 1, wherein the system comprises at least two tanks and a first dosage cylinder coupled to a first tank has a first volume, and a second dosage cylinder coupled to a second tank has a second volume, wherein the first and second volumes are different.

13. The system of claim 1, wherein the control system is configured to transmit data to and receive data from a remote computing system.

14. A method for injecting tagging material into a drilling fluid, the method comprising:

opening, by a control system, a first valve to allow a first tagging material to flow from a first tank into a first dosage cylinder;

closing, by the control system, the first valve after a first specified duration of time, the first specified duration of time being a length of time for a specified volume of the tagging material to flow into the first dosage cylinder;

pressurizing, by the control system, the first dosage cylinder to a specified pressure by enabling a pressurized gas to flow into the dosage cylinder;

opening, by the control system, a second valve to inject the first tagging material from the first dosage cylinder into a drilling fluid flowline; and closing, by the control system, the second valve after a second specified duration of time, the second specified duration of time being a length of time for the specified volume of the tagging material in the first dosage cylinder to be injected into the drilling fluid flowline.

15. The method of claim 14, further comprising: measuring, by the control system using a pressure transducer, a pressure in a pneumatic system to confirm that the first tagging material was injected into the drilling fluid flowline.

16. The method of claim 14, further comprising: receiving, by the control system through a user interface, the first and second specified durations of time.

17. The method of claim 14, further comprising: injecting, by the control system, a second tagging material from a second tank into the drilling flowline by:

opening, by the control system, a third valve to allow the second tagging material to flow from the second tank into a second dosage cylinder;

closing, by the control system, the third valve after a third specified duration of time;

opening, by the control system, a fourth valve to inject the second tagging material from the second dosage cylinder into the drilling fluid flowline; and closing, by the control system, the fourth valve after a fourth specified duration of time.

18. The method of claim 17, wherein the first tagging material and the second tagging material are injected in the drilling fluid flowline to form an identifiable combination of tagging materials.

19. The method of claim 17, wherein the first tagging material and the second tagging material are injected into the drilling fluid flowline concurrently.

20. The method of claim 14, further comprising automatically injecting, by the control system, tagging material into the drilling flowline according to a set schedule based on drilling parameters associated with drilling a wellbore in a subsurface formation.

* * * * *